United States Patent [19]

Chin et al.

[11] 4,174,983

[45] Nov. 20, 1979

[54] FE-CR-CO MAGNETIC ALLOY PROCESSING

[75] Inventors: Gilbert Y. Chin, Berkeley Heights; Sungho Jin, Meyersville; John T. Plewes, Berkeley Heights; Bud C. Wonsiewicz, Summit, all of N.J.

[73] Assignee: Bell Telephone Laboratories, Incorporated, Murray Hill, N.J.

[21] Appl. No.: 924,137

[22] Filed: Jul. 13, 1978

[51] Int. Cl.[2] ..... H01F 1/02

[52] U.S. Cl. ..... 148/102; 148/121; 148/126

[58] Field of Search ..... 148/102, 121, 126

[56] References Cited

U.S. PATENT DOCUMENTS

| | | | |
|---|---|---|---|
| 2,506,624 | 5/1950 | Wirsching | 179/120 |
| 3,806,336 | 4/1974 | Kaneko et al. | 75/126 H |
| 3,954,519 | 5/1976 | Inoue | 148/121 |
| 3,982,972 | 9/1976 | Iwata et al. | 148/121 |
| 3,989,556 | 11/1976 | Iwata et al. | 148/121 |
| 4,075,437 | 2/1978 | Chin et al. | 75/126 H |

OTHER PUBLICATIONS

IEEE Trans. on Magnetics, p. 1440.
Proc. 3rd European Conference on Hard Magnetic Materials, p. 197.
Bell System Technical Journal, vol. 30, pp. 110–140, 1951.
AIP Conference Proc. No. 5, p. 1088.
IEEE Trans. on Magnetics, p. 347.
Proc. 3rd. European Conf. on Hard Magnetic Materials, p. 201.

*Primary Examiner*—L. Dewayne Rutledge
*Assistant Examiner*—John P. Sheehan
*Attorney, Agent, or Firm*—Peter A. Businger

[57] ABSTRACT

A method is disclosed for making a metallic body having desirable magnetic properties. The metallic body is made from an alloy which contains Fe, Cr, and Co and which may also contain one or several additional ferrite forming elements such as, e.g., Zr, Mo, V, Nb, Ta, Ti, Al, Si, or W. According to the disclosed method the alloy is cooled at a rate of at least 60 degrees C. per hour from an initial temperature at which the alloy is in an essentially single phase alpha state to a second temperature which is in a vicinity of 600 degrees C. Subsequently, the alloy is cooled at a second, slower rate to a third temperature which is in the vicinity of 525 degrees C.

The disclosed method allows for a relatively broad range of initial temperatures, is relatively insensitive to compositional variations of the alloy, and permits simple reclamation of suboptimally treated parts. As a consequence, the method is particularly suited for large scale industrial production of permanent magnets as may be used, e.g., in relays, ringers, and electro-acoustic transducers.

18 Claims, 2 Drawing Figures

FE-CR-CO MAGNETIC ALLOY PROCESSING

BACKGROUND OF THE INVENTION

1. Field of the Invention

The invention is concerned with the manufacture of magnetic materials.

2. Description of the Prior Art

Magnetic alloys containing Fe, Cr, and Co have received considerable attention on account of potentially high values of magnetic coercivity, remanence, and energy product achievable in such alloys. When suitably processed and shaped, these alloys may be advantageously used, e.g., in the manufacture of relays, ringers, and electro-acoustic transducers such as loudspeakers and telephone receivers.

Use of Fe-Cr-Co alloys in preference, e.g., to Fe-Al-Ni-Co or Fe-Co-Mo alloys is further based on mechanical properties and, in particular, on low-temperature formability of the alloy in a suitably annealed condition. For example, alloys disclosed in U.S. Pat. No. 4,075,437, "Composition, Processing, and Devices Including Magnetic Alloy", issued Feb. 21, 1978 may be shaped, e.g., by cold deformation into telephone receiver magnets whose design is disclosed in the paper by E. E. Mott and R. C. Miner, "The Ring Armature Telephone Receiver", *Bell System Technical Journal,* Vol. 30, pages 110–140 (1951) and in U.S. Pat. No. 2,506,624, "Electroacoustic Transducer", issued May 9, 1950.

While certain ternary Fe-Cr-Co alloys are disclosed in the paper by H. Kaneko et al., "New Ductile Permanent Magnet of Fe-Cr-Co System", *AIP Conference Proceedings No.* 5, pages 1088–1092 (1972), a number of disclosures are concerned with the presence in the alloy of limited amounts of certain fourth elements. For example, the paper by H. Kaneko et al., "Fe-Cr-Co Permanent Magnet Alloys Containing Silicon", *IEEE Transactions on Magnetics,* September 1972, pages 347–348, U.S. Pat. No. 3,806,336, "Magnetic Alloys", issued Apr. 23, 1974, and U.S. Pat. No. 3,982,972, "Semihard Magnetic Alloy and a Process for the Production Thereof", issued Sept. 28, 1976 are concerned with properties of alloys containing silicon. The addition of molybdenum as well as the addition of silicon are disclosed in the paper by A. Higuchi et al., "A Processing of Fe-Cr-Co Permanent Magnet Alloy", *Proceedings 3rd European Conference on Hard Magnetic Materials,* pages 201–204 (1974). The paper by W. Wright et al., "The Effect of Nitrogen on the Structure and Properties of Cr-Fe-Co Permanent Magnet Alloys" and U.S. Pat. No. 3,989,556, "Semihard Magnetic Alloy and a Process for the Production Thereof", issued Nov. 2, 1976 disclose the addition of titanium, the former for the purpose of guarding against a possible adverse influence on magnetic properties due to the presence of dissolved nitrogen and the latter for the purpose of achieving semihard magnetic properties in the alloy. The paper by H. Kaneko et al., "Fe-Cr-Co Permanent Magnet Alloys Containing Nb and Al", *IEEE Transactions on Magnetics,* Vol. MAG-11, pages 1440–1442 (1975) and U.S. Pat. No. 3,954,519, "Iron-Chromium-Cobalt Spinodal Decomposition Type Magnetic Alloy Comprising Niobium and/or Tantalum", issued May 4, 1976 disclose the addition of alpha-forming elements.

Processing of Fe-Cr-Co alloys typically involves preparing a melt of constituent elements Fe, Cr, Co, and possibly one or several additional elements, casting an ingot from the melt, and thermo-mechanically processing the cast ingot. It is generally recognized that achievement of high coercivity in such alloys is concomitant to the development of a spinodal structure, namely a submicroscopically fine two-phase structure in which an iron-rich phase is interspersed with a chromium-rich phase.

Exemplary thermomechanical processing of alloys containing Fe, Cr, and Co conducive to the development of a spinodal structure is disclosed in U.S. Pat. No. 4,075,437, and may proceed by subjecting an ingot to hot working, quenching, solution annealing, quenching, cold working, and aging. As a result of such processing, applied to an exemplary alloy containing 58.5 weight percent Fe, 26.5 weight percent Cr, 15 weight percent Co, 0.25 weight percent Zr, 1 weight percent Al, and 0.5 weight percent Mn, desirable magnetic and mechanical properties were obtained. Specifically, magnetic properties obtained were a coercivity of 450 Oersted, a remanence of 8300 Gauss, and a usable energy product of $1.6\times10^6$ Gauss-Oersted.

SUMMARY OF THE INVENTION

The invention is a method for developing desirable magnetic property in alloys which contain Fe, Cr, and Co and which may also contain one or several additional ferrite forming elements such as, e.g., Zr, Mo, V, Nb, Ta, Ti, Al, Si, or W. The method calls for a two-stage aging treatment which may be applied to a metallic body shaped, e.g., as cast, as hot worked, as cold worked, or as prepared by powder metallurgy. Initially, the alloy is maintained at a first temperature at which the alloy is in an essentially single phase alpha state and which is preferably in the range of 650°–775° C. From such first temperature, the alloy is rapidly cooled at a first rate in a preferred range of 60° to 650° C. per hour to a second temperature in a preferred range of 585°–625° C. and then cooled more slowly at a second rate in a preferred range of 2° to 30° C., per hour to a third temperature in a preferred range of 500°–550° C. Processing according to the invention allows for a relatively broad range of initial temperature and permits holding the alloy at such temperature for a period of up to several hours. Furthermore, the method is relatively insensitive to compositional variation from alloy to alloy and permits for simple reclamation of suboptimally aged parts. As a consequence, the method is particularly suited for large scale industrial production of magnets as may be used, e.g., in relays, ringers, and electro-acoustic transducers.

DETAILED DESCRIPTION

Figure 1:
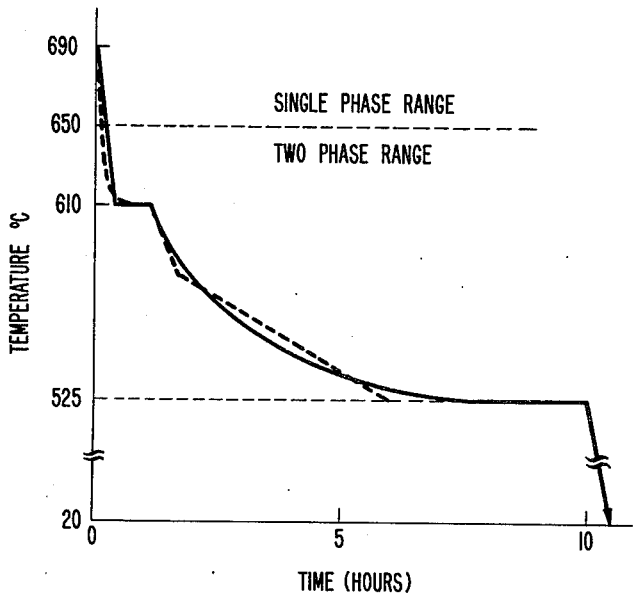
FIG. 1 is a diagram which graphically depicts functional relationships of temperature versus time corresponding to exemplary heat treatment within the scope of the disclosed method.

Processing according to the invention may be beneficially applied to a metallic body of a Fe-Cr-Co alloy having any desired size and shape. Such body may be prepared from constituent elements, e.g., by casting from a melt or by powder metallurgy. In the case of an ingot cast from a melt, additional processing steps such as, e.g., hot working, cold working, and solution annealing may be included for purposes such as grain refining, shaping, or the development of desirable mechanical properties in the alloy.

Constituent elements Fe, Cr, and Co, in combination, should preferably be present in the alloy in an aggregate amount of at least 95 weight percent; the remaining at most 5 weight percent may comprise one or more elements such as, e.g., Zr, Mo, V, Nb, Ta, Ti, Al, Si, W, S, Mn, C, or N which may be added intentionally or which may be present as impurities when commercial grade constituents are used. Mn, in particular, may be added to bind unintentionally present sulphur whose presence in elemental form tends to embrittle the alloy. Silicon may be added as a flux.

Cr and Co are preferably present in respective amounts of 20–35 weight percent and 5–25 weight percent relative to the aggregate amount of Fe, Cr, and Co.

To suppress an undesirable nonmagnetic gamma phase which tends to develop especially at higher Co levels or in the presence of excessive amounts of impurities such as C, N, or O, ferrite forming elements may be added to the alloy. However, addition of excessive amounts of such elements may tend to harden and embrittle the alloy and to interfere with magnetic properties. When used for the purpose of gamma suppression, ferrite forming elements should be added in a preferred amount of at least 0.1%.

Preferred upper limits on individual ferrite forming elements Zr, Mo, V, Nb, Ta, Ti, Al, Si, and W are as follows: 1 weight percent Zr, 5 weight percent Mo, 5 weight percent V, 3 weight percent Nb, 3 weight percent Ta, 5 weight percent Ti, 3 weight percent Al, 3 weight percent Si, and 5 weight percent W. At lower levels of Co contents and at low impurity levels ferrite forming elements may be dispensable as disclosed in U.S. patent application Ser. No. 924,138.

The disclosed method, as applied to an alloy having a composition as described above, may be viewed as conducive to the production of a fine-scale spinodally decomposed two-phase structure comprising an iron-rich phase and a chromium-rich phase, such structure being considered desirable in the interest of developing high coercivity in the alloy. In terms of such structure it has been discovered that particle size and morphology of the iron-rich phase may be optimized, prior to optimization of compositional difference between phases, by an aging treatment which calls for rapidly cooling the alloy from an initial temperature at which the alloy is in an essentially single phase state. Such initial temperature is preferably chosen in the range of 650°–775° C., a preferred lower limit of 650° C. being generally at or above the phase boundary for alloys of the invention, and a preferred upper limit of 775° C. being motivated primarily by processing convenience, higher initial temperatures being neither precluded nor considered advantageous for the purpose of the invention. The alloy should be maintained at such initial temperature for a period which is sufficient for the establishment of an essentially uniform temperature throughout the alloy. In the interest of minimizing sigma phase, holding at such initial temperature should preferably not exceed 5 hours. Heating rate to achieve the initial temperature is not critical and may typically be in the range of $10^{2°}$–$10^{6°}$ C. per hour.

Preferred initial cooling rate from the initial temperature to a temperature in the vicinity of 610° C. and in a preferred range of 585°–625° C. is dependent on Co content of the alloy. Specifically, such cooling rate should be chosen in a preferred range of 60°–200° C. per hour for alloys containing 5 weight percent Co and in a preferred range of 250°–650° per hour for alloys containing 25 weight percent Co, preferred limits on cooling rates for alloys containing intermediary amounts of Co being conveniently obtainable by interpolating linearly between preferred limits specified at 5 and 25 weight percent Co. Actual cooling may be carried out, e.g., so as to result in a linear decrease in temperature as shown by the solid line in FIG. 1 or so as to result in an exponential decrease as shown by the dashed curve in FIG. 1.

Figure 2:
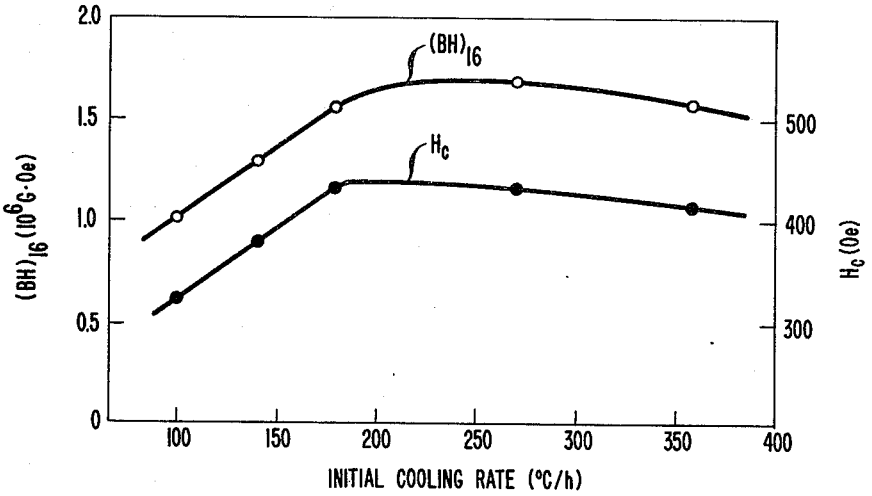
FIG. 2 is a diagram which graphically depicts energy product and coercivity as a function of initial cooling rate for an alloy composed of 27 weight percent Cr, 15 weight percent Co, 1 weight percent Al, 0.25 weight percent Zr, and remainder Fe and treated according to a method as disclosed.

FIG. 2 illustrates the influence of initial cooling rate on magnetic properties of a specific alloy containing 27 weight percent Cr, 15 weight percent Co, 1 weight percent Al, 0.25 weight percent Zr, and remainder Fe. It can be seen from FIG. 2 that for initial cooling rates in an approximate preferred range of 150°–450° C./h as determined by approximate linear interpolation as suggested above, coercivity $H_c$ and energy product $(BH)_{16}$ are relatively weakly dependent on cooling rate.

If cooling is carried out, e.g., by linearly decreasing furnace temperature, it may be advantageous to include a holding step at a temperature in the range of 585°–625° C., typically for a duration of 10 minutes to 1 hour, to achieve uniform temperature distribution in the alloy prior to the second cooling step.

Subsequent to initial rapid cooling from a first temperature to a second temperature and, possibly, holding at such second temperature as described above, a second cooling step at a rate in a preferred range of 2°–30° C. per hour is called for. Exponential temperature decrease as shown by the solid curve in FIG. 1 is desirable in the interest of spinodal phase separation; alternatively, such curve may be approximated by a number of discrete steps or by a linear or piecewise linear curve (as exemplified by the dashed curve in FIG. 1 which shows a piecewise linear time-temperature relationship represented by line segments having different slopes), followed by holding for a period of 1–10 hours at a third and final temperature in a preferred range of 500°–550° C. Upon completion of such second cooling step, the alloy may be air cooled or water quenched to room temperature.

There are several aspects of the disclosed method which make it particularly suitable for large scale industrial practice. For example, relatively wide ranges for initial temperature and holding time are advantageous where heavy loads are processed, where prolonged heating is required to reach equilibrium temperature, and where, even at equilibrium temperature, there may be some non-uniformity of temperature inside a large furnace. Also, variations in alloy composition as they may occur from heat to heat are easily accommodated due to the relatively weak dependence of initial temperature and first cooling rate on alloy composition. Finally, the method permits easy reclamation of suboptimally aged parts by simple repetition of the aging treatment and without any additional preliminary steps such as, e.g., solution annealing followed by quenching.

Magnetic properties developed in alloys by processing according to the disclosed methods are at levels which make such alloys applicable, e.g., in electroacoustic transducers such as loudspeakers and telephone receivers, in relays, and in ringers. Specifically, values of magnetic energy product $(BH)_{max}$ in the range of 1.0–2.0 MGOe are typically achieved. While still higher magnetic properties are achievable by aging treatment utilizing a magnetic field, the disclosed method, in the interest of ease of manufacture, is preferably carried out in the absence of such field.

EXAMPLE 1

An ingot of an alloy containing 27 weight percent Cr, 15 weight percent Co, 1 weight percent Al, 0.25 weight percent Zr, and a remainder Fe was cast from a melt. Ingot dimensions were a thickness of 7 inches, a width of 9 inches, and a length of 45 inches. The cast ingot was hot rolled at a temperature of 1250° C. into a quarter inch plate. The plate was water cooled and sections of the plate were cold rolled at room temperature into strips having a thickness of 0.1 inch. The strips were solution annealed at 900° C. and water cooled. An aging treatment according to the invention was initiated at 680° C. Initial cooling was at a rate of 200° C. per hour to a temperature of 610° C. and was followed by cooling at exponentially decreasing rates in the range of 2°–30° C./h. Aging was terminated by holding for 3 hours at 525° C. Measured magnetic properties were as follows: Remanence $B_r$=9100 Gauss, coercivity $H_c$=430 Oerstedt, energy product $(BH)_{16}$=1.58 MGOe at the load line B/H=16, and maximum energy product $(BH)_{max}$=1.64 MGOe.

EXAMPLE 2

An ingot of an alloy containing 27 weight percent Cr, 11 weight percent Co, and remainder Fe was cast from a melt. Ingot dimensions were a thickness of 1.25 inches, a width of 5 inches, and a length of 12 inches. The cast ingot was hot rolled at a temperature of 1250° C. into a quarter inch plate which was water cooled. Sections of the plate were cold rolled at room temperature into strips having a thickness of 0.1 inch, solution annealed at 930° C., and water cooled. Aging of strips according to the invention was initiated at various initial temperatures lying in the range of 650°–720° C. and initial holding times were chosen in the range of 5 minutes to 2hours. Cooling was at initial rates in the range of 60°–140° C./h to a final temperature of 525° C. In spite of such considerable variation in initial temperatures, holding times and cooling rates, energy products in the narrow range of 1.36–1.57 MGOe were measured.

We claim:

1. Method for producing a magnetic metallic body by an aging treatment of an alloy of which an aggregate amount of at least 95 weight percent consists of Fe, Cr, and Co, said aggregate amount having a Cr content in the range of 20–35 weight percent and a Co content in the range of 5–25 weight percent CHARACTERIZED IN THAT said aging treatment comprises the steps of (1) maintaining said alloy at a first temperature corresponding to an essentially single phase alpha state so as to produce in said alloy an essentially single phase alpha structure, (2) lowering the temperature of said alloy from said first temperature to a second temperature in the range of 585°–625° C. at a rate which over essentially the entire range of temperatures between said first temperature and said second temperature is in the range of 60°–650° C./h, and (3) lowering the temperature of said alloy from said second temperature to a third temperature in the range of 500°–550° C. at a rate which over essentially the entire range of temperatures between said second temperature and said third temperature is in the range of 2°–30° C./h. 20

2. Method of claim 1 in which said first temperature is in the range of 650°–775° C.

3. Method of claim 1 in which said alloy consists essentially of Fe, Cr, and Co.

4. Method of claim 1 in which said alloy contains at least one fourth element selected from the group consisting of 0.1–1 weight percent Zr, 0.1–5 weight percent Mo, 0.1–5 weight percent V, 0.1–3 weight percent Nb, 0.1–3 weight percent Ta, 0.1–5 weight percent Ti, 0.1–3 weight percent Al, 0.1–3 weight percent Si, and 0.1–5 weight percent W.

5. Method of claim 1 in which said alloy is maintained at said first temperature for a period of at most 5 hours.

6. Method of claim 1 in which said alloy is maintained at said second temperature for a period of 10 minutes to 1 hour.

7. Method of claim 1 in which lowering of temperature in step (2) is carried out in an essentially linear fashion.

8. Method of claim 1 in which lowering of temperature in step (2) is carried out in an essentially exponential fashion.

9. Method of claim 1 in which said first rate is in the range of 60°–200° C. per hour when said Co content is 5 weight percent and in the range of 250°–650° C. per hour when said Co content is 25 weight percent, ranges corresponding to intermediate levels of Co content being obtained by linear interpolation.

10. Method of claim 1 in which lowering of temperature in step (3) is carried out according to an essentially linear or piecewise liner time-temperature relationship.

11. Method of claim 1 in which lowering of temperature in step (3) is carried out by steps.

12. Method of claim 1 in which lowering of temperature in step (3) is carried out in an essentially exponential fashion.

13. Method of claim 1 in which said alloy is maintained at said third temperature for a period of 1–5 hours.

14. Method of claim 1 in which said metallic body is shaped as cast.

15. Method of claim 1 in which said metallic body is shaped as hot work prior to step (1).

16. Method of claim 1 in which said metallic body is shaped as cold worked prior to step (1).

17. Method of claim 1 in which said metallic body is solution annealed prior to aging.

18. Method of claim 1 in which said metallic body is shaped as formed by powder metallurgy.

* * * * *